United States Patent [19]

Byrd

[11] Patent Number: 4,545,460

[45] Date of Patent: Oct. 8, 1985

[54] LADDER FASTENING DEVICE FOR POLE CLIMBING

[76] Inventor: James L. Byrd, 9320 N. Morrish Rd., Montrose, Mich. 48457

[21] Appl. No.: 663,435

[22] Filed: Oct. 22, 1984

[51] Int. Cl.[4] ..... E06C 7/48

[52] U.S. Cl. ..... 182/107; 182/93

[58] Field of Search ..... 182/107, 108, 93, 9

[56] References Cited

U.S. PATENT DOCUMENTS

| | | | |
|---|---|---|---|
| 548,076 | 10/1895 | Mack | 182/9 |
| 1,882,381 | 10/1932 | Davis | 182/9 |
| 3,037,579 | 6/1962 | Barrow | 182/107 |
| 3,792,756 | 2/1974 | Kelly | 182/107 |
| 4,363,378 | 12/1982 | Williams | 182/107 |

*Primary Examiner*—Reinaldo P. Machado
*Attorney, Agent, or Firm*—Harry R. Dumont

[57] ABSTRACT

A ladder fastening device for pole climbing. The device includes a central strap portion operable to be wrapped around a pole and having free end portions. A pair of end straps are included each connected to a different end of the central strap portion and operable to be wrapped about the legs of a ladder previously leaned against the pole. Each of the end straps has a pair of rigid buckles connected to an end for engaging the free end of the central strap portion. There is included at the other end of each end strap a latching means for looping each end strap around one of the legs.

5 Claims, 2 Drawing Figures

LADDER FASTENING DEVICE FOR POLE CLIMBING

BACKGROUND OF THE INVENTION

A problem exists in servicing electrical power distrbution systems. In some cases, it is expedient to use a ladder leaned against the utility pole, tree or the like which is then climbed for servicing. There is a hazard in mounting a ladder that is not securely fastened to the pole particularly with its likelihood of sliding to the left or to the right and injuring the person.

The present invention relates to a fastening device for a ladder used. The fastening device includes an adjustable length central strap portion which is wrapped around the circumference of the pole. A pair of end portions are used to separately engage and fasten the ladder legs in a position previously set against the pole. Each of the end portions is separately wrapped and fastened to keep the ladder in a fixed position.

The present device was developed to provide a pcrtable, readily useable fastening device adjustable to fit a large range of sizes of poles, tree trunks or the like.

SUMMARY OF THE INVENTION

The ladder fastening device is fabricated in three separate strap portions which are easily carried, stored for transport, and light of weight. The use of canvas web straps provides sufficient strength yet retains the light weight feature. It is possible for the person using the fastening device to set it in place with respect to the pole and ladder before he starts to make his climb. Latching is quickly done and undone to facilitate the operation.

BRIEF DESCRIPTION OF THE DRAWINGS

The present invention will now be described in the accompanying specification and with reference to the drawings in which like numerals are used to identify like parts in the different views and in which.

DETAILED DESCRIPTION OF THE PREFERRED EMBODIMENT

Figure 1:
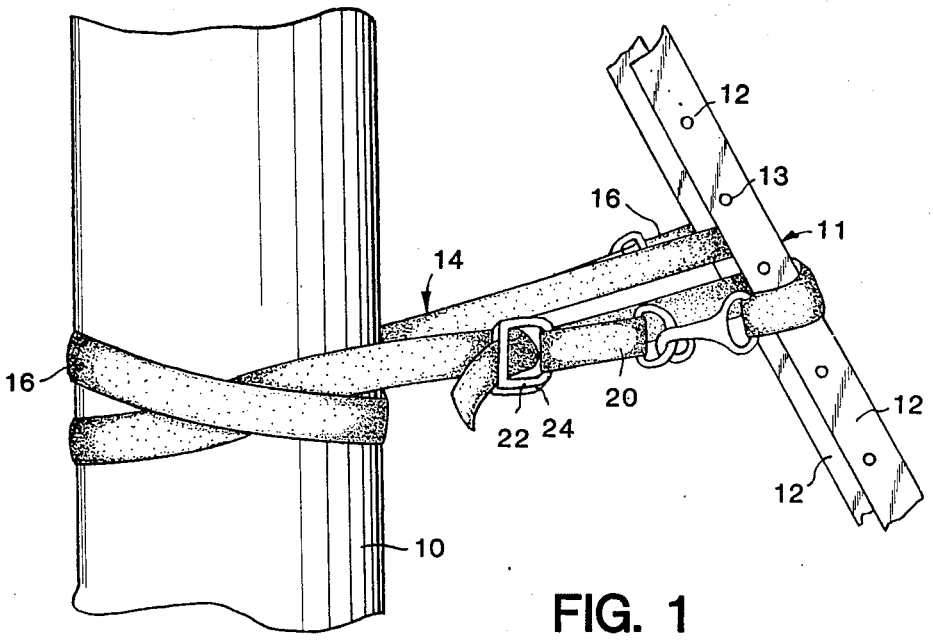
FIG. 1 a fragmentary front perspective view showing the fastening device in place.

FIG. 1 shows a pole 10 to which is being fastened a ladder 12. The strap type fastening device is indicated generally by the numeral 14. Included in the fastening device 14 is a central strap portion 16 that is wrapped around the circumference of the pole 10. The several straps used in this device are preferably fabricated of a canvas web material.

Figure 2:
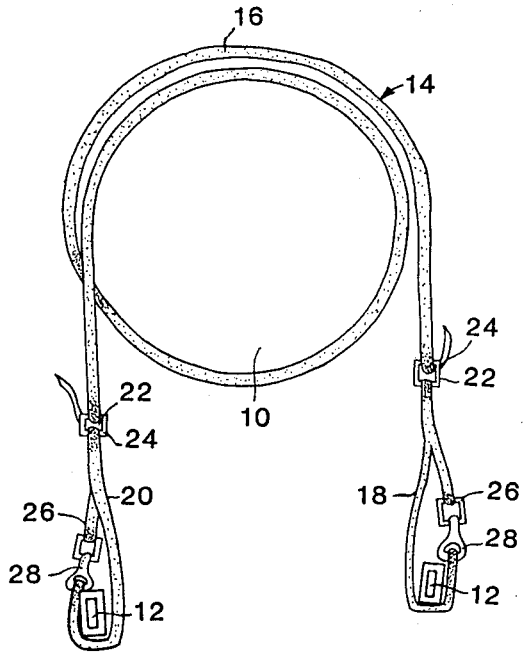
FIG. 2 is a top plan view further showing the detail of the fastening device.

As better shown in FIG. 2, the fastening device also includes a pair of end straps 18 and 20. Each of the end straps has attached to its end a pair of buckles 22, 24. The free ends of the central portion 16 are passed intermediate the buckles 22, 24 and are thus attached thereto. The buckles 22, 24 are preferably bound of metal or high strength, high import plastic material. The free ends of the central strap portion 16 can be pulled between their releasably locked position intermediate the buckles 22, 24 so as to adjustably vary the length of the central strap 16 to conform to the circumference of the pole 10. Both FIGS. 1 and 2 show the manner in which the central strap portion is looped around the pole 10. The conventional ladder 11 comprises a pair of aligned legs 12 and a plurality of rungs 13 holding the legs together 12 and equally spaced one frcm the other. The end straps 20 each includes a latching means for wrapping the respective end straps around the two ladder legs 12 as shown. The latching means in each case comprises a loop 26 and a locking part 28 engagable about the loop 26 and preferably of the spring biased type to insure locking of the end straps about the ladder legs 12.

In operation, the central pcrtion 16 is looped around the circumference of the pole 10 and the length of the central portion 16 is adjusted by pulling the free ends of it between the buckles 22, 24 to tighten the ladder with its upper rung in tight holding contact with the periphery of the pole 10. The end straps 18 and 20 are then fastened about the periphery of the two ladder legs 12 thus holding the ladder 12 tightly braced against the pole 10.

It will thus be seen that I have provided by my invention a novel and improved fastening device of the strap type for holding a ladder in a secure and rigid position against a pole, tree trunk or the like.

I claim:

1. A ladder fastening device for pole climbing, comprising:

a central strap portion wrapable around the pole and having free end portions;

a pair of end straps, each connectable to a different end portion of said central strap portion, each end strap having a pair of rigid buckles connected to one end and a latching means connected to the other end;

said central strap pcrtion having its respective end portions engageable with said buckles of each end strap for overall length adjustment.

2. The combination as set forth in claim 1 wherein said rigid buckles are fabricated from metal.

3. The combination as set forth in claim 1 wherein said buckles are fabricated from a high strength, high density plastic material.

4. The combination as set forth in claim 1 wherein said latching means comprises a loop and a spring closure means operable to be locked in said loop.

5. The combination as set forth in claim 1 in which said strap comprises a canvas web material.

* * * * *